United States Patent [19]

Greene

[11] 4,012,311

[45] Mar. 15, 1977

[54] SHORT RESIDENCE TIME LOW PRESSURE HYDROPYROLYSIS OF CARBONACEOUS MATERIALS

[75] Inventor: Marvin Greene, Somerset, N.J.

[73] Assignee: Cities Service Company, Tulsa, Okla.

[22] Filed: Oct. 30, 1975

[21] Appl. No.: 627,448

[52] U.S. Cl. ..... 208/8; 208/11 R; 208/142

[51] Int. Cl.[2] ..... C10G 1/06

[58] Field of Search ..... 208/8, 11 R, 142

[56] References Cited

UNITED STATES PATENTS

| | | | |
|---|---|---|---|
| 3,030,297 | 4/1962 | Schroeder | 208/8 |
| 3,111,395 | 11/1963 | Sweeney | 208/8 |
| 3,839,186 | 10/1974 | Berger | 208/8 |
| 3,855,070 | 12/1974 | Squires | 208/8 |

*Primary Examiner*—Delbert E. Gantz
*Assistant Examiner*—James W. Hellwege
*Attorney, Agent, or Firm*—John W. Carpenter; George L. Rushton

[57] ABSTRACT

A process for treating carbonaceous material with hydrogen at low pressure including adding the carbonaceous material into a first reaction zone of a reactor having at least two reaction zones; adding hot hydrogen to the stream of carbonaceous material to effect a reaction with same to produce reaction products; quenching the mixture while insuring that the total residence time varies from about 2 milliseconds to about 2 seconds; removing at least a portion of the reaction products from the quenched mixture; and introducing the residual carbonaceous material into a subsequent reaction zone and repeating the steps for the subsequent reaction zone.

12 Claims, 1 Drawing Figure

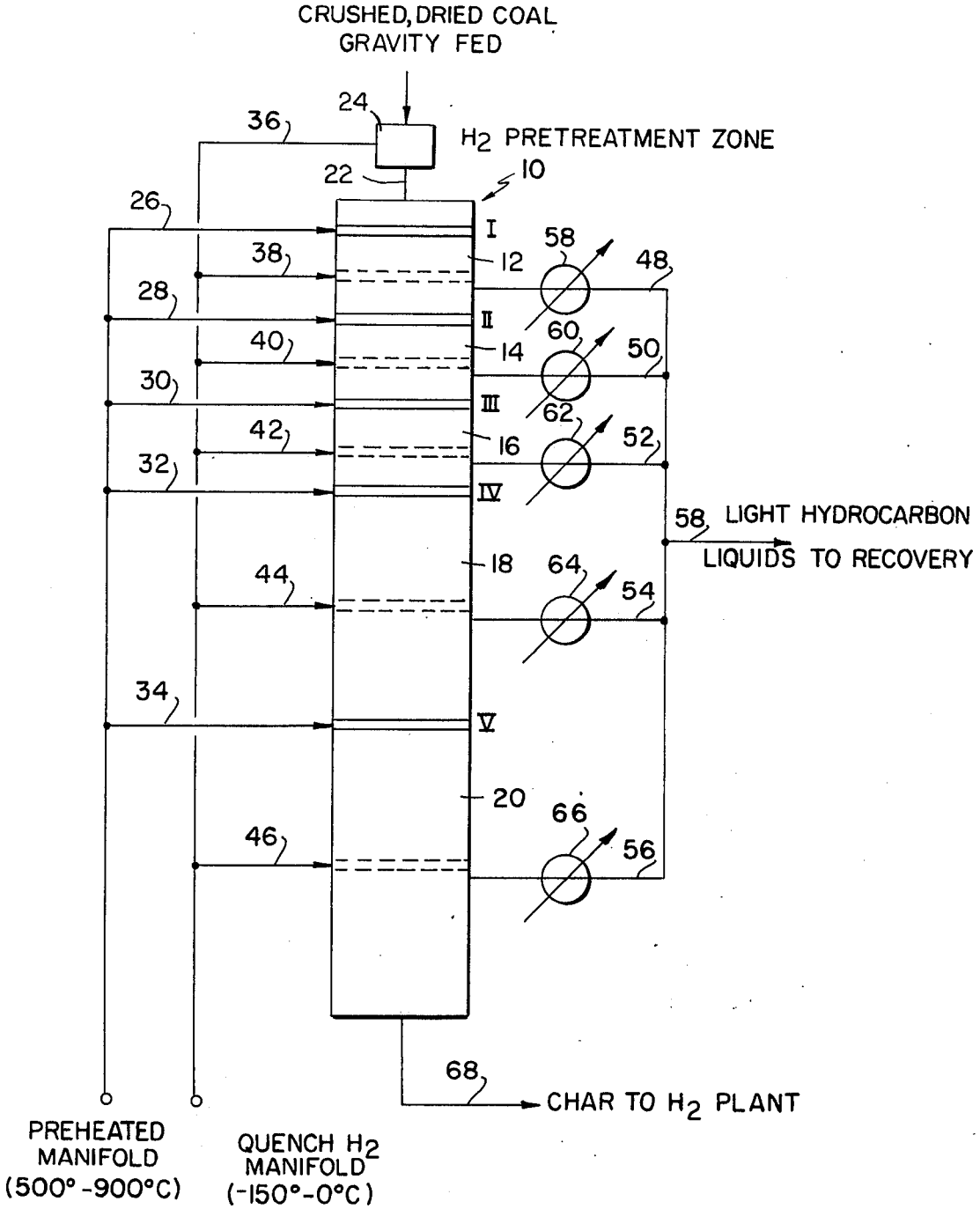
CRUSHED, DRIED COAL
GRAVITY FED
24
36
H2 PRETREATMENT ZONE
22
10
26
I
58
38
12
48
28
II
60
40
14
50
30
III
62
42
16
52
32
IV
58 LIGHT HYDROCARBON
LIQUIDS TO RECOVERY
18
64
44
54
34
V
20
66
46
56
68
CHAR TO H2 PLANT
PREHEATED
MANIFOLD
(500°-900°C)
QUENCH H2
MANIFOLD
(-150°-0°C)

SHORT RESIDENCE TIME LOW PRESSURE HYDROPYROLYSIS OF CARBONACEOUS MATERIALS

BACKGROUND OF THE INVENTION

1. Field of the Invention

This invention relates to coal hydrogenation. More particularly, it relates to a process for treating coal with hydrogen, in the absence of added catalyst and/or solvent, to obtain a high yield of coal tars. The utility of the invention resides in the production of desirable long chain aromatic hydrocarbons from coal.

2. Description of the Prior Art

Processes for treating coal with hydrogen have been known for many years. Prior art references include U.S. Pat. No. 2,658,861; 2,832,724; 3,030,297; and 3,152,063. Typically, these processes have mixed crushed coal with various solvents, with or without added catalyst, and have treated the mixture to reaction temperature, for an extended period of time, in the presence or absence of hydrogen. Such processes have generally given a wide range of products, from gases to light hydrocarbons to high-boiling liquids, in addition to the solid residues. For example, U.S. Pat. No. 3,823,084, issued to W. C. Schroeder on July 9, 1974, discloses mixing coal and hydrogen, in the absence of a solvent, passing the mixture through a bed of hydrogenation catalyst, and recovering liquid and gaseous hydrocarbon products from the product stream. The disadvantages of such processes include addition of a catalyst that will survive the severe reaction conditions, removal of the catalyst from the effluent stream, recovery of a broad spectrum of gaseous, low-boiling and high-boiling liquids, the necessity for solvent addition and removal, and additional processing steps to separate, remove and recycle various portions of the reaction stream.

SUMMARY OF THE INVENTION

It is therefore an object of this invention to provide a process for short residence time low pressure hydropyrolysis of coal.

It is another object of this invention to provide a process for short residence time low pressure hydropyrolysis of coal which doesn't include the disadvantages of the prior art.

Still other objects will be apparent to those skilled in the art from the following description of this invention.

The foregoing objects are achieved according to the practice of this invention. Broadly, this invention comprises a process for treating carbonaceous material with hydrogen, in the absence of added catalyst, to produce a high yield of carbonaceous tars including, in serial combination, the following steps: adding liquid or crushed solid carbonaceous material into a first reaction zone of a reactor having at least two reaction zones; and a pressure of between atmospheric pressure and 450 psia, adding hot hydrogen to the stream of carbonaceous material to affect a reaction with same to produce reaction products; quenching the mixture while insuring that the total residence time varies from about 2 milliseconds to about 2 seconds; removing at least a portion of the reaction products from the quenched mixture; and introducing the residual carbonaceous material into a subsequent reaction zone and repeating the foregoing steps for the subsequent reaction zone. The process, involving short heat-up (preferably between 500° C/sec and 300,000° C/sec) and quench times, results in improved yields of desirable carbonaceous tar products, no problems of catalyst addition or removal, simplified apparatus, and improved process reliability. In a narrower aspect, this invention comprises a process for converting coal into coal tars which includes the following steps: introducing in a continuous stream finely divided coal into a first reaction zone of a pressure vessel having at least two reaction zones and a pressure between atmospheric pressure and 450 psia; continuously adding hot hydrogen to the first reaction zone of the pressure vessel so as to impinge the coal stream and effect a reaction with same to produce coal tars reaction products; limiting contact between the hydrogen and coal stream within the first reaction zone of the vessel to a period of less than 2 seconds; subsequently quenching the hot hydrogen-coal stream within the first reaction zone with cold hydrogen removing at least a portion of the coal tars from the quenched coal tar-coal stream; and introducing the residual coal to a subsequent reaction zone and repeating the steps for the subsequent reaction zone. The separated coal tar stream can then be processed further. The heart of the invention resides in a concept of a short total residence time of the carbonaceous material at low pressure in each reaction zone of the reactor; this residence time includes heat-up, reaction, and quench times. This short residence time contrasts sharply with other high pressure hydrogenation processes involving catalyst and solvents wherein relatively long residence times are involved and the reaction mixture is quenched outside the reactor.

These, together with various ancillary objects and features which will become apparent as the following description precedes are obtained by this novel process, a preferred schematic embodiment is shown in the accompanying drawings, by way of example only wherein:

BRIEF DESCRIPTION OF THE DRAWING

FIG. 1 is a schematic drawing of a distillation low pressure hydrogenation reactor for performing short residence time low pressure hydropyrolysis of carbonaceous material.

DETAILED DESCRIPTION OF THE INVENTION

With continuing reference to the drawing wherein similar parts of the invention are identified by the same reference numeral, reactor, generally illustrated as 10, having (at least two) reaction zones 12, 14, 16, 18 and 20, has carbonaceous feed material fed thereto via conduit 22 after passing through a pretreatment zone 24. Hot hydrogen is added to reaction zones 12, 14, 16, 18 and 20 through conduits 26, 28, 30, 32, and 34, respectively. Quenching material is fed to pretreatment zone 24 through conduit 36, and is additionally fed to reaction zones 12, 14, 16, 18 and 20 via conduits 38, 40, 42, 44, and 46, respectively. Coal tar liquids exit reaction zones 12, 14, 16, 18 and 20 through lines 48, 50, 52, 54 and 56, respectively, and are subsequently processed via conduit to recovery. Flow meters 58, 60, 62, 64 and 66 are respectively situated on lines 48, 50, 52, 54 and 56 to gauge the flow of the coal tar products. Char is recovered through conduit 68.

Feed material for the process broadly includes carbonaceous material, exemplified by coal, lignite, peat, oil shale, tar sands, organic waste, Orinoco tar, gilsonite, and crude oil. A preferred embodiment of the invention uses coal as the solid feed material. It is noted that all of these feed materials, except conventional crude oil, are solids at ambient temperatures.

The solid feed material is crushed to a particle size of less than 1 inch. It is preferred that the particle size be less than about ½ inch, and the most preferred particle size is in the range of 50 to 200 mesh (U.S. Sieve).

The process can utilize almost any hydrogen stream as long as the hydrogen content of the stream is sufficient to react with the carbonaceous material and does not contain deleterious components. Broadly, the incoming hydrogen stream for each reaction zone can vary from about 30% hydrogen to about 100% hydrogen, based on the partial pressure of hydrogen. Since recycle of a portion of the effluent gas stream is contemplated in the process, the reactant hydrogen stream can also contain components such as methane, propane, and ethane, with these components typically not condensing as they are cooled to quench temperatures.

Since the process involves the mixing and reaction of carbonaceous material and feed hydrogen in each of the reaction zones 12, 14, 16, 18 and 20, the hydrogen-to-carbonaceous material weight ratio is an important consideration. Broadly, this weight ratio in each of the reaction zones can vary from about 0.05 to about 4, with the higher value showing an excess of hydrogen and the lower value resulting in the formation of more char, with reduced amounts of desirable product. A more desirable hydrogen-to-carbonaceous material weight ratio in each of the reaction zones is in the range of from about 0.12 to about 2, and the most preferred ratio is from about 0.6 to about 1.2.

Coal enters reactor 10 through conduit 22 after having been in pretreatment zone 24 and falls by gravity through reaction zones 12, 14, 16, 18, and 20, in order stated. The amount of residence time in each reaction zone depends on the size of the coal particles entering the reactor 10— the larger particles spend less time in each reaction zone because of their tendency to fall faster through each zone. Each reaction zone comprises hot hydrogen which has been injected to the coal to effect a reaction with same to produce coal tar liquids reaction products. Coal tar liquids that initially form during short residence time hydropyrolysis of coal adhere to the coal particle surfaces. Preferably these coal tar liquids have to be removed from the coal particles during this stepwise short residence time hydropyrolysis of coal in order to prevent blockage of the coal surfaces by the adhered liquids and to prevent polymerization of these liquids to solid residue. This boundary layer would inhibit the release of additional coal tar liquids from the coal. The stepwise removal of the boundary layer can be carried out in any one of the following reactors: free fall having reaction zones superimposed, dispersed phase reactor, or transport reactor. In a preferred embodiment of the invention the reactor is of the free fall type of FIG. 1. The liberation of the boundary layer can be accomplished by, for example, shock cooling with hydrogen at a temperature below 0° C. Preferably, each reaction zone quenches with hydrogen at a temperature below 0° C. As was previously mentioned, conduits 38, 40, 42, 44, and 46 carry quenching hydrogen to each of the respective reaction zones. Each reaction zone additionally has communicating therewith a line (i.e. either 48, 50, 52, 54 and 56) to remove the coal tar liquids after quenching. The residual coal continues to fall into a succeeding reaction zone wherein another heating, quenching and recovery step is performed. As previously mentioned, this stepwise removal is necessary to prevent blockage of the coal surfaces by the adhered liquids and ensuing polymerization of these tars on the coal particles. The number of preheating and quenching steps (i.e. stages) will depend on the size and type of coal, reaction temperature and pressure. In a preferred embodiment of FIG. 1, it has been calculated that about preferably 20 milliseconds reaction time (coal residence time) is required for each preheat/quench stage. The reactor length between each preheat and quench stage can then be chosen to generate a reactor system with the specified residence time required for a given conversion and selectivity.

Since an important aspect of this invention resides in the low pressure rapid heating up and cooling down of the reactants and reaction mixture, respectively, the temperature of the incoming reactants is of some importance. Typically, the temperature of the incoming carbonaceous material is desirably ambient. It is recognized that, due to conduction, radiation and convection from the hot reactor, the incoming feed material may be heated somewhat. Any tendency to overheat the material to near reaction temperatures can be reduced by various designs to cool the feed material or to move it at such a rate that it does not have time to be heated appreciably.

Hydrogen pretreatment zone 24 is provided to promote intimate contact of the coal surfaces with hydrogen prior to thermal treatment at low pressure which initiates the hydrogenation and/or devolatilization reactions. This should assure that if the free radical, polymerization precursors were to exist instantaneously in the pores of the coal upon devolatilization, hydrogen will be omnipresent to stabilize the radicals and hence prevent polymerization.

Prior art processes raise the temperature of the reactants comparatively slowly, such as by using preheaters for the reacting mixture or by heating the reactor externally. Our process is based on heating the reactant hydrogen to above the reaction temperature and then rapidly impinging this hot hydrogen onto the incoming carbonaceous feed material, within each reaction zone of the reactor 10 at a low pressure.

The temperature of the incoming hot hydrogen within each reaction zone will vary somewhat, depending on the desired hydrogen-to-carbonaceous material weight ratio of the reactant mixture and upon the desired reaction temperature within each reaction zone in the reactor. Typically the inlet hydrogen temperature within each reaction zone should be approximately 50° C. higher than the reaction temperature, when the hydrogen-to-carbonaceous material ratio is around 1, with this temperature difference resulting in a rapid heat-up time greater than about 500° C. per second.

To overcome the reactor pressure, both the carbonaceous material and the incoming hydrogen within each reaction zone must be fed in at a pressure exceeding that of the reactor. Suitable mechanical arrangements, such as a pressurized hopper or star feeder, or pneumatic feeding devices, are available for feeding the carbonaceous material into the low pressurized reactor. Cooling coils may be combined with the mechanical arrangements to reduce the tendency to pre-heat the incoming carbonaceous material. Once the carbonaceous material enters the reactor 10 of FIG. 1 it falls by gravity through each of the reaction zones. In a preferred embodiment said reaction zones are superimposed with respect to each other. Similarly, the pressure of the incoming hydrogen within each reaction zone will exceed that of the reactor. The combination of a slight excess of incoming hydrogen pressure and the weight of the incoming carbonaceous material results in a continuous mass flow of reactants through the reactor.

The reaction temperature within each reaction zone can vary from about 400° to about 2000° C., with a preferable range being from about 500° to about 1500° C., and a most preferred range of from about 600° C. to about 1000° C. The reactor pressure can vary from about 0 to about 450 psia, preferably from about 100 to 150 psia. The total residence time of the reactants in each reaction zone of the reactor can vary from about 2 milliseconds to about 2 seconds, preferably from about 5 milliseconds to about 1 second, with a most preferred residence time of from 10 milliseconds to about 900 milliseconds. As was previously mentioned, residence time primarily depends on the size of the particles of the carbonaceous material (i.e. coal) entering into the first reaction zone of the reactor 10.

This total residence time includes the heat-up, reaction and quench times. Since there is reaction between the carbonaceous material and feed hydrogen as soon as the feed material enter each reaction zone of the reactor and are mixed, and since this reaction continues until the quenched mixture exits the reactor, it is difficult to separate the various phases of the total residence time. It is implicit in the invention that the rates of heat-up and quench be rapid. Direct or indirect quench can be used. The heat-up rate of the carbonaceous material is preferably between about 500° C/sec and 100,000° C/sec.

The quench material added directly into each reaction zone can be, broadly, any of a wide variety of gases or liquids that can be added quickly to the reactant mixture in order to cool the mixture below the effective reacting temperature while the mixture is in the reactor. Materials that are non-reactive with the reactant mixture are preferred, but many common materials can be used. These can include a portion of the recycled gas stream from the process (having components such as methane, ethane, propane), inert gasses such as helium, or argon, and even such materials as water, nitrogen and $CO_2$. Although these latter materials can react at the temperature found in the reactor, it is understood that these materials can be added to the reactant stream, from the recycle gas stream, at such a temperature and in such volume so that the result is a quenching of the reactant stream, rather than additional reaction between the reactant stream and the quenched material. Hydrogen is thus the preferred quench material, with a process recycle stream rich in hydrogen being a natural extension of the preferred embodiment. Depending upon the reaction temperature and the mass flow through the reactor, a sufficient amount of quenching material, at a suitable temperature, is added to the reactant stream within each reaction zone so that the resultant mixture, near the exit of the reactor, has a temperature of about 100°–200° C. The temperature and the amount of quenched material added to each reaction zone are sufficient to quench the reaction mixture rapidly. The pressure of the entering quench material for the first reaction zone 12 is naturally higher than that of the pressure within the reactor. Desirably, the quench temperature for each reaction zone should be below the effective reacting temperature of the components, yet should be high enough to insure that the products of reaction in each reaction zone are in the coal tar state, to facilitate downstream separation.

The weight ratio of quench material to product stream within each reaction zone is dependent upon such factors as the reaction temperature, components of product stream, excess of hydrogen, and other conditions. Quenching is a function of the sensible heat in the reaction mixture and in the quench stream.

After the quenched reaction mixture departs the last reaction zone 20 of the reactor 10, any unreacted solid material, such as ash or char, enters the char pot and is recovered therefrom, while the remainder of the effluent stream from each reaction zone, typically predominantly containing coal tars, proceeds to downstream processing units.

Typically, the major products from this process are char, and a high yield of coal tars which include between about 10 and 80 carbon atoms and are predominantly 2–8 ring aromatics such as anthracene, phenanthrene and benzarthracene. The constituents of coal tar are well known to those skilled in the art and may be found in such references as the Handbook of Chemistry and Physics, 48th Edition, published by the Chemical Rubber Co. (see page C-12).

The hydrogen used in the process can be obtained from any commercial source, such as char gasification, naphtha and/or methane steam reforming, or cracking of ethane to produce ethylene. The steps of producing, storing, heating, cooling and recycling the hydrogen are well known and need not be discussed here. Reactor design, though an important consideration in terms of economics, is not an essential part of this invention. Any reactor design that will allow for the fast heat-up of the feed carbonaceous material, a short reaction time, and a fast quench of the product stream within each reaction zone can be used for the invention.

My invention will be illustrated by the following set forth examples which are given by way of illustration and not by any limitations. All parameters such as concentrations, mixing proportions, temperatures, pressures, rates, compounds, etc., submitted in these examples are not to be construed to unduly limit the scope of our improved process for short residence time low pressure hydropyrolysis of coal.

EXAMPLE 1

Illinois No 6 (HvbC), VM MF 36.6%, Ash MF 10.8%, Fix. C MF 52.6, ground to 50 × 100 mesh (U.S. Sieve), was fed to a hydrogenation reactor with two stages. The coal assayed 71.2%C, 4.8%H, 1.4%N, 2.9%S, 9.5%O, on moisture-ash-free (MAF) basis. The reactor conditions for each stage were 5 psia, 1700° F, $H_2$ Conc. 90 98, Heating rate 160,000° F/SEC, Quench Temp. 400° F, $H_2$/Coal, (lb/lb.) 1.0, Heat-up Time (sec.) 0.010, Reaction Time, (sec.) 0.900, and Quench Time (Sec.) 0.020.

Processing and analysis of the reactor effluent from all reaction zones, neglecting excess $H_2$, gave these results per ton of MAF feed coal;

| | |
|---|---|
| C | 80.5 |
| H | 7.0 |
| N | 1.2 |
| S | 2.0 |
| O | 9.2 |

-continued

| | |
|---|---|
| API Gr. | −4 |
| Pour Pt. ° F | 115 |
| Viscosity, SSU | 1330 |
| HHV, Btu/lb. | 15050 |
| Metals, ppm | 600 |
| AST Moist, ° F | |
| IBP | 450 |
| 50% | 900 |
| E.P./% Rec. | 1100/60% |
| Tar Yield, bbl/ton MAF | 3.3 |

EXAMPLE 2

Colorado A (HvbB), VM MF 36.8%, Ash MF 8.1%, Fix C MF 55.1, ground to 40 × 200 mesh (U.S. Sieve), was fed to a hydrogenation reactor with three stages. The coal assayed 73.5%C, 5.1%H, 1.6%N, 0.7%S, 11.0%O, on moisture-ash-free (MAF) basis. The reactor conditions for each stage were 25 psia, 1900° F, $H_2$ Conc. % 90, Heating rate 120,000° F/SEC, Quench Temp. 350° F, $H_2$/Coal, (lb/lb.) 0.50, Heat-up Time, (sec.) 0.015, Reaction Time (sec.) 0.500, and Quench Time (sec.) 0.010.

Processing and analysis of the reactor effluent from all reaction zones, neglecting excess $H_2$, gave these results per ton of MAF feed coal;

| | |
|---|---|
| C | 83.6 |
| H | 8.3 |
| N | 1.1 |
| S | 0.4 |
| O | 6.6 |
| API Gr. | −4 |
| Pour Pt. ° F | 108 |
| Viscosity, SSU | 1090 |
| HHV, Btu/lb. | 16000 |
| Metals, ppm | 350 |
| AST Moist, ° F | |
| IBP | 460 |
| 50% | 920 |
| E.P./% Rec. | 980/58% |
| Tar Yield, bbl/ton MAF | 3.0 |

EXAMPLE 3

Utah Hiawatha (HvbB) VM MF 42.5%, Ash MF 5.0%, Fix C MF 52.5 ground to 20 × 235 mesh (U.S. Sieve), was fed to a hydrogenation reactor with four stages. The coal assayed 77.1%C, 6.2%H, 1.4%N, 0.5%S, 9.8%O, on moisture-ash-free (MAF) basis. The reactor conditions for each stage were 10 psia, 1500° F, $H_2$ Conc.% 85, Heating rate 70,000° F/SEC, Quench Temp. 300° F, $H_2$/Coal, (lb/lb.) 2.0, Heat-up Time, (sec.) 0.020, Reaction Time, (sec.) 0.100, and Quench Time (sec.) 0.100.

Processing and analysis of the reactor effluent from all reaction zones, neglecting excess $H_2$, gave these results per ton of MAF feed coal:

| | |
|---|---|
| C | 83.7 |
| H | 8.6 |
| N | 1.0 |
| S | 0.2 |
| O | 6.5 |
| API Gr. | −3 |
| Pour Pt. ° F | 130 |
| Viscosity, SSU | 390 |
| HHV, Btu,/lb. | 16500 |
| Metals, ppm | 190 |
| IBP | |
| 50% | 658 |
| E.P./% Rec. | 720/88% |

-continued

| | |
|---|---|
| Tar Yield, bbl/ton MAF | 3.0 |

EXAMPLE 4

Wyoming Big Horn (Sub. B), VM MF 33.9%, Ash MF 18.8%, Fix. C MF 47.3, ground to −200 mesh (U.S. Sieve), was fed to a hydrogenation reactor with five stages. The coal assayed 77.1%C, 6.2%H, 1.4%N, 0.5%S, 9.8%O, on moisture-ash-free (MAF) basis. The reactor conditions for each stage were 250 psia, 2250° F, $H_2$ Conc.% 80, Heating rate 430,000° F/SEC, Quench Temp. 300° F, $H_2$/Coal, (lb/lb.) 3.0, Heat-up Time, (sec.) 0.005, Reaction Time, (sec.) 0.050, and Quench Time (sec.) 0.005.

Processing and analysis of the reactor effluent from all reaction zones neglecting excess $H_2$, gave these results per ton of MAF feed coal:

| | |
|---|---|
| C | 82.7 |
| H | 8.0 |
| N | 1.0 |
| S | 0.6 |
| O | 7.5 |
| API Gr. | −4 |
| Pour Pt. ° F | 120 |
| Viscosity, SSU | 228 |
| HHV, Btu/lb. | 15100 |
| Metals, ppm | 100 |
| AST Moist, ° F | |
| IBP | 425 |
| 50% | 820 |
| E.P./% Rec. | 850/52% |
| Tar Yield, bbl/ton MAF | 2.5 |

I claim:

1. A process for treating carbonaceous material with hydrogen, in the absence of added catalyst, to produce a high yield of carbonaceous tars, comprising, in serial combination, a. adding liquid or crushed solid carbonaceous material into a first reaction zone of a reactor having at least two reaction zones; and a pressure of between atmospheric pressure and 450 psia;

b. adding hot hydrogen to the stream of carbonaceous material to effect a reaction with same to produce reaction products at a temperature of between 400° C and 2000° C.;

c. quenching the mixture of step (b) while insuring that the total residence time of heat-up, reaction and quenching of said mixture varies from about 2 milliseconds to about 2 seconds;

d. removing at least a portion of the reaction products from said quenched mixture of step (c); and e. introducing the residual carbonaceous material into a subsequent reaction zone and repeating steps (a) – (d) for said subsequent reaction zone.

2. The process of claim 1, wherein the crushed solid material has an average particle size smaller than about ½ inch.

3. The process of claim 2, wherein the ratio of carbonaceous material to hydrogen, in the carbonaceous material-hydrogen mixture in each of said reaction zones varies from about 0.05 to about 4.

4. The process of claim 3, wherein the heat-up time of said carbonaceous material is between about 500° C/sec and 300,000° C/sec.

5. The process of claim 4, wherein the temperature of the quenched mixture in each reaction zone does not exceed about 200° C.

6. The process of claim 5, wherein the quenching material is hydrogen at a temperature below 200° C and the carbonaceous material is coal.

7. The process of claim 6 wherein said reaction zones are superimposed with respect to each other.

8. The process of claim 7 wherein said reaction products are removed from the surface of the carbonaceous material.

9. The process of claim 8 wherein said reaction includes five reaction zones and said carbonaceous material is gravity fed through each of said reaction zones.

10. A process for converting coal into coal tars comprising the steps of:

a. Introducing a continuous stream of finely divided coal into a first reaction zone of of a pressure vessel having at least two reaction zones and a pressure between atmospheric pressure and 450 psia;

b. continuously adding hot hydrogen to the first reaction zone of the pressure vessel so as to impinge the coal stream and effect a reaction with same to produce coal tars reaction products at a temperature between about 400° C and about 2000° C;

c. subsequently quenching the hot hydrogen-coal stream within the first reaction zone with cold hydrogen;

d. limiting the total residence time of heat-up, reaction, and quenching of said mixture within the first reaction zone of the vessel to a period of less than 2 seconds;

e. removing at least a portion of the coal tars from the quenched hydrogen-coal stream; and f. introducing the residual coal into a subsequent reaction zone and repeating the steps (a) – (e) for the subsequent reaction zone.

11. The method of claim 10, wherein:

a. The coal has an average particle size of less than about ½ inch;

b. the hydrogen/coal weight ratio of the reaction mixture in each reaction zone varies from about 0.05 to about 4;

c. the reaction temperature varies from about 500° C. to about 1500° C;

d. the total residence time of hydrogen and coal in each reaction zone is not more than about 1 second;

e. the cold hydrogen quenched stream has a temperature of below about 200° C; and f. the separated liquid hydrocarbon stream is further processed.

12. The method of claim 10, wherein the separated coal tars are further processed, said coal tars having compounds which include bewtween about 10 to 80 carbon atoms.

* * * * *

UNITED STATES PATENT OFFICE

CERTIFICATE OF CORRECTION

Patent No. 4,012,311 Dated March 15, 1977

Inventor(s) Marvin Greene

It is certified that error appears in the above-identified patent and that said Letters Patent are hereby corrected as shown below:

Column 1, line 20 "have treated the mixture"
should read, "have heated the mixture"

Column 6, line 56 "$H_2$ Conc. 90 98"
should read, "$H_2$ Conc. % 98"

Signed and Sealed this ninth Day of August 1977

[SEAL]

*Attest:*

RUTH C. MASON
*Attesting Officer*

C. MARSHALL DANN
*Commissioner of Patents and Trademarks*